US007926925B2

(12) United States Patent
Ikezaki

(10) Patent No.: US 7,926,925 B2
(45) Date of Patent: Apr. 19, 2011

(54) INK PACK HAVING WELDED TAP AND INK CARTRIDGE

(75) Inventor: Yoshiyuki Ikezaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 738 days.

(21) Appl. No.: 11/365,817

(22) Filed: Mar. 2, 2006

(65) Prior Publication Data

US 2006/0197813 A1 Sep. 7, 2006

(30) Foreign Application Priority Data

Mar. 4, 2005 (JP) ..... 2005-060523

(51) Int. Cl.
*B41J 2/125* (2006.01)

(52) U.S. Cl. ..... 347/86; 347/84; 347/85; 383/26; 383/27; 383/42; 383/46; 383/67

(58) Field of Classification Search ..... 347/84, 347/85, 86; 383/26, 27, 42, 46, 66, 67, 76
See application file for complete search history.

(56) References Cited

U.S. PATENT DOCUMENTS

| | | | | |
|---|---|---|---|---|
| 4,415,886 | A | 11/1983 | Kyogoku et al. | |
| 6,220,702 | B1 | 4/2001 | Nakamura et al. | |
| 6,382,593 | B1 * | 5/2002 | deCler et al. | 251/340 |
| 6,468,377 | B1 * | 10/2002 | Sperko et al. | 156/229 |
| 2001/0043256 | A1 * | 11/2001 | Seccombe et al. | 347/85 |
| 2002/0122084 | A1 * | 9/2002 | Shihoh et al. | 347/7 |
| 2004/0178106 | A1 * | 9/2004 | Morita | 206/459.1 |

FOREIGN PATENT DOCUMENTS

| | | |
|---|---|---|
| JP | A-10-250747 | 9/1998 |
| JP | A-11-1250 | 1/1999 |
| JP | A-11-180463 | 7/1999 |
| JP | A-11-236062 | 8/1999 |
| JP | A-2000-62813 | 2/2000 |
| JP | A 2000-238291 | 9/2000 |
| JP | A-2003-94688 | 4/2003 |
| JP | A-2004-114557 | 4/2004 |
| JP | A-2004-210321 | 7/2004 |
| JP | A-2004-315067 | 11/2004 |
| JP | A-2004-359255 | 12/2004 |

OTHER PUBLICATIONS

Sep. 7, 2010 Office Action in Japanese Application No. 2005-060523, with translation.
Feb. 1, 2011 Office Action in Japanese Application No. 2005-060523, with translation.

* cited by examiner

*Primary Examiner* — Laura E Martin
(74) *Attorney, Agent, or Firm* — Oliff & Berridge, PLC

(57) ABSTRACT

There is provided an ink pack, which is provided with a film bag that has a sealed chamber therein and is formed of a flexible film member having a form of a bag, and a tap that has an ink flow channel therein and is welded to one edge of the flexible film member. In this structure, a film welding part, in which opposed inner surfaces of the flexible film member are welded to each other, is formed at least along the one edge of the flexible film member. A tap welding part, in which a side of the tap is welded to opposed inner surfaces of the flexible film member, is formed in the one edge of the flexible film member. Further, a welding width of a side of the film welding part adjacent to the tap welding part is larger than a welding width of a side of the tap welding part adjacent to the film welding part.

18 Claims, 10 Drawing Sheets

INK PACK HAVING WELDED TAP AND INK CARTRIDGE

CROSS-REFERENCE TO RELATED APPLICATION

This application claims priority under 35 U.S.C. §119 from Japanese Patent Application No. 2005-060523, filed on Mar. 4, 2005. The entire subject matter of the application is incorporated herein by reference.

BACKGROUND

1. Technical Field

Aspects of the present invention relate to an inkjet recording device, and particularly to an ink pack and an ink cartridge for supplying ink.

2. Description of Related Art

An inkjet recording device configured to eject ink onto a recording medium in accordance with an input signal has been widely used. In general, such an inkjet recording device is provided with an ink cartridge to supply ink to an inkjet head. Inside of a case of the ink cartridge, an ink pack containing ink is accommodated. If an inkjet recording device runs out of ink, a user replaces the ink cartridge with new one.

FIG. 9 is a plan view of a conventional ink pack 100 illustrating a producing process of the ink pack 100. FIG. 10 is a plan view of the ink pack 100. As shown in FIG. 9, the ink pack 100 is formed by folding a flexible sheet member 102 (made of two layers of resin having property of a gas barrier) in two, welding (by a heat seal) peripheral parts of the folded sheet 102, and thereby forming a sheet welding part 103. A part of one of edges of the folded sheet member 102 is not welded so that a space (a tap attachment part 104) to which a tap 101 is inserted can be formed. The tap 101 is used to introduce ink contained in the ink pack 100 to the outside of the ink pack 100. The tap 101 has a rubber stopper (not shown) fitted thereto.

As shown in FIG. 10, by fitting the tap 101 into the tap attachment part 104 of the flexible sheet member 102 and welding an attached part of the tap 101 to the tap attachment part 104, a tap welding part 105 is formed. Consequently, a sealed space (a sealed ink chamber 106) which is to be filled with ink is formed in the flexible sheet member 102.

In Japanese Paten Provisional Publication No. 2000-238291 (hereafter, referred to as JP 2000-238291A), an ink pack for an inkjet recording device is disclosed. According to JP 2000-238291A, the ink pack can be formed as follows. A tube-shaped body is formed by welding longer edges of each second film (forming a side part of the ink pack) to longer edges of each first film (forming a flat part of the ink pack). Then, shorter edges of the flat parts are welded to each other so that the tube-shaped body is formed into a bag shape, and an ink supplying tap is welded to the other shorter side of the body. Next, a band-shaped joint part extending from a side of the body to an adjacent side is formed at each corner of the body so as to strengthen parts of the body at which the films overlap with each other and to prevent the body from being damaged by the external pressure. Consequently, the ink pack having ink supplying performance can be formed.

As described above, the flexible sheet member 102 is welded to the tap 101. There is a possibility that a resin dissolves from the flexible sheet member 102 and the tap 101 when they are welded to each other, and the dissolved resin solidifies at the outside of an appropriate welding range. Hereafter, such a dissolved resin is referred to as a poly pool. If such a phenomenon occurs in the ink pack 100, the poly pools 107 appear at the inside edge of a junction part of the flexible sheet 102 and the tap 101 (i.e., the inside of the sealed ink chamber 106), as shown in FIG. 10.

Hereafter, a relationship between the strength of the poly pool 107 and the strength of the ink pack 100 will be explained. FIG. 11 is an enlarged partial side sectional view of the ink pack 100. In general, the ink pack 100 is lightweight and flex. Therefore, if an external pressure acts on the ink pack 100 or if ink swings in the ink pack 100 during transport of the ink cartridge accommodating the ink pack 100, stress acts on the ink pack 100 and therefore the ink sheet member 102 deforms according to the stress.

If stress acts on the ink pack 100, the ink pack deforms around the welding part between the tap 101 and the flexible sheet member 102, as an axis, i.e., the tap bends in the back and forth direction relative to the flexible sheet member 102, around the axis. In this case, stress directly acts on the poly pools 107 because the poly pools 107 exist at the welding part of the tap 101 and the flexible sheet member 102.

The strength of the poly pools 107 are relatively low because the excessive heat has been applied thereto during the welding. Therefore, the flexible sheet member 102 is ripped at the part around the poly pools 107. In a low ambient temperature environment, the strength of a film (i.e., the flexible member 102) further decreases. Therefore, a possibility that the flexible sheet member 102 is ripped increases. That is, the conventional ink pack has a drawback that the poly pool causes a break of the ink pack or damage to the ink pack.

The structure of the ink pack disclosed in JP 2000-238291A does not provide a solution to such a draw back of the conventional ink pack.

SUMMARY

Aspects of the present invention are advantageous in that an ink pack, capable of preventing occurrence of a break and damage of a pack at a position of a poly pool and increasing the mechanical strength of the pack, is provided.

BRIEF DESCRIPTION OF THE ACCOMPANYING DRAWINGS

DETAILED DESCRIPTION

General Overview

Figure 1:
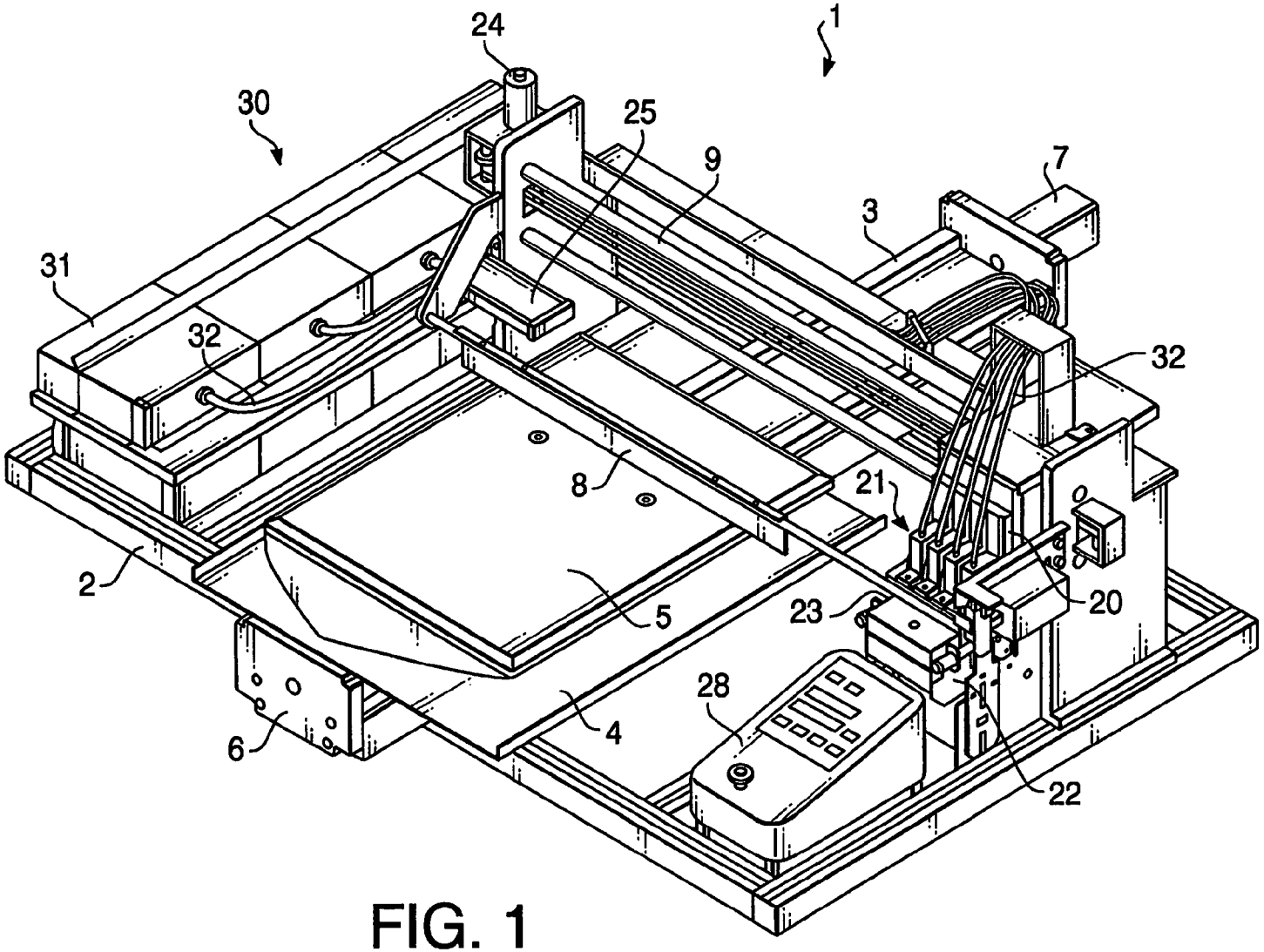
FIG. 1 is a perspective view of an inkjet printer in which an ink pack and an ink cartridge according to embodiments of the invention are employed.

According to an aspect of the invention, there is provided an ink pack, which is provided with a film bag that has a sealed chamber therein and is formed of a flexible film member having a form of a bag, and a tap that has an ink flow channel therein and is welded to one edge of the flexible film member. In this structure, a film welding part, in which opposed inner surfaces of the flexible film member are welded to each other, is formed at least along the one edge of the flexible film member. A tap welding part, in which a side of the tap is welded to opposed inner surfaces of the flexible film member, is formed in the one edge of the flexible film member. Further, a welding width of a side of the film welding part adjacent to the tap welding part is larger than a welding width of a side of the tap welding part adjacent to the film welding part.

With this configuration, poly pools, that appear when the tap is welded to the flexible film member, are protected in the film welding part. Therefore, it is possible to prevent the film bag from being ripped or damaged at the position of the poly pools. The mechanical strength of the ink pack can be enhanced.

Optionally, a cylindrical ink channel may be formed along a direction of the ink flow channel in a space formed between the tap welding part and the sealed chamber.

With this configuration, the tap communicates with the sealed ink chamber through the cylindrical ink channel, and it is possible to prevent the ink pack from being bent at the position of the poly pools.

Still optionally, an ink channel welding part, in which opposed inner surfaces of the flexible film member are welded to each other, may be formed in the one edge of the flexible film member so that a width of a part of the cylindrical ink channel is narrowed.

With this configuration, the protection of the poly pools and the prevention of the bending at the position of the poly pools can be securely attained.

Still optionally, the film welding part may have a part inclined with respect to one of edges of the flexible film member so that an area of an opening of the sealed chamber becomes narrower toward the tap.

With this configuration, it is possible to smooth the ink flow from the sealed ink chamber toward the outside of the tap.

Still optionally, the flexible film member may have a laminated structure, and inner surfaces of the flexible film member and the tap may be made of the same material.

With this configuration, it is possible to securely weld the tap to the film member.

Still optionally, the laminated structure of the film member may include a layer configured to block passing of water and air.

With this configuration, it is possible to prevent the deterioration of the ink in the sealed ink chamber.

According to another aspect of the invention, there is provided an ink cartridge, which is provided with the above mentioned ink pack, and a case that accommodates the ink pack.

Such a configuration allows the ink pack to be easily attached to an ink jet recording device.

ILLUSTRATIVE EMBODIMENTS

Hereafter, illustrative embodiments according to the invention will be described with reference to the accompanying drawings.

First Embodiment

FIG. 1 is a perspective view of an inkjet printer 1 in which an ink pack 10 and an ink cartridge 31 according to a first embodiment of the invention are employed. The inkjet printer 1 is used to print images on fabric such as a T-shirt.

A configuration of the inkjet printer 1 will be described with reference to FIG. 1. The inkjet printer 1 includes a box-shaped housing 2 elongated in a lateral direction. Two rails 3 elongated along the back and forth direction of the housing 2 are located at the central portion of the bottom of the housing 2. The two rails 3 are held by a base part (not shown) of the housing 2 standing up in the vertical direction. A plate-like platen base (not shown) is held on the rails 3 slidably in the back and forth direction. A platen 5 is detachably attached to the top of a column standing from the central part of the platen base.

The platen 5 is a plate-like member elongated in the back and forth direction if it is viewed as a plan view. A recording medium (i.e., fabric in this embodiment) is loaded and held on the top surface of the platen 5. A tray 4 is fixed to the central portion of the column between the platen 5 and the platen base. The tray 4 prevents fabric (T-shirt) from falling to the bottom of the housing 2 when a user loads the fabric onto the platen 5.

At the rear edge of a platen driving mechanism 6 (including the rails 3), a platen driving motor 7 used to drive (i.e. reciprocates) the platen base in the back and forth direction along the rails 3 is provided.

Over the platen 5, a guide rail 9 is provided at the center position in the back and forth direction of the housing 2, bridging the top portions of side walls of the housing 2. The guide rail 9 guides movement of a carriage 20. By driving force of a carriage motor 24 located at the left side of the housing 2, the carriage 20 moves (i.e., reciprocates) along the guide rail 9 in the lateral direction.

Cyan ink, magenta ink, yellow ink and black ink are used in the inkjet printer 1. At the left side portion of the housing 2, four ink cartridges 31 respectively corresponding to the four colors are located. The four cartridges 31 are accommodated respectively in four cartridge containment portions 30. As described later, each ink cartridge 31 accommodates an ink pack 10 (see FIG. 5). An ink supply tube 32 having flexibility is connected to each cartridge containment portion 30, and ink in the ink pack 10 is introduced from the ink pack 10 to a corresponding inkjet head 21 thought the corresponding ink supply tube 32.

Four inkjet heads 21 are provided in the carriage 20. Each inkjet head 21 has 128 ejection channels (not shown) and respective ejection nozzles located at the bottom surface thereof. Each of the ejection channels includes a piezoelectric actuator. In this structure, drops of ink are ejected from each nozzle downward onto fabric.

At the right edge of the guide rail 9, a purge unit 22 is located. The purge unit 22 includes a suction cup 23 capable of closely contacting or departing from a nozzle surface of each inkjet head 21. The purge unit 22 is also provided with a suction pump (not shown) serving to suck ink remaining on the nozzle surface of each inkjet head 21 when the suction cup 23 closely contacts the nozzle surface of the inkjet head 21. The suction cup 23 covers the nozzle surface of each inkjet head 21 when a printing operation is not performed so that drying of ink in each nozzle is prevented.

At the left edge portion of the guide rail 9, an ink tray 25 is provided. The ink tray 25 receives ink which is ejected from each inkjet head 21 for prevention of increase of viscosity of ink due to drying. A clearance sensor 8 elongated in the lateral direction is provided at the front of the guide rail 9. The clearance sensor 8 serves to detect impediments (e.g., wrinkles or debris on fabric loaded on the platen 5) to movement of the platen 5 in the back and forth direction during the printing operation. An operation panel 28 is provided at the right front portion of the housing 2. The operation panel 28 is provided with a display and various operation buttons including an print button, a stop button and a platen carrying button.

Figure 2:
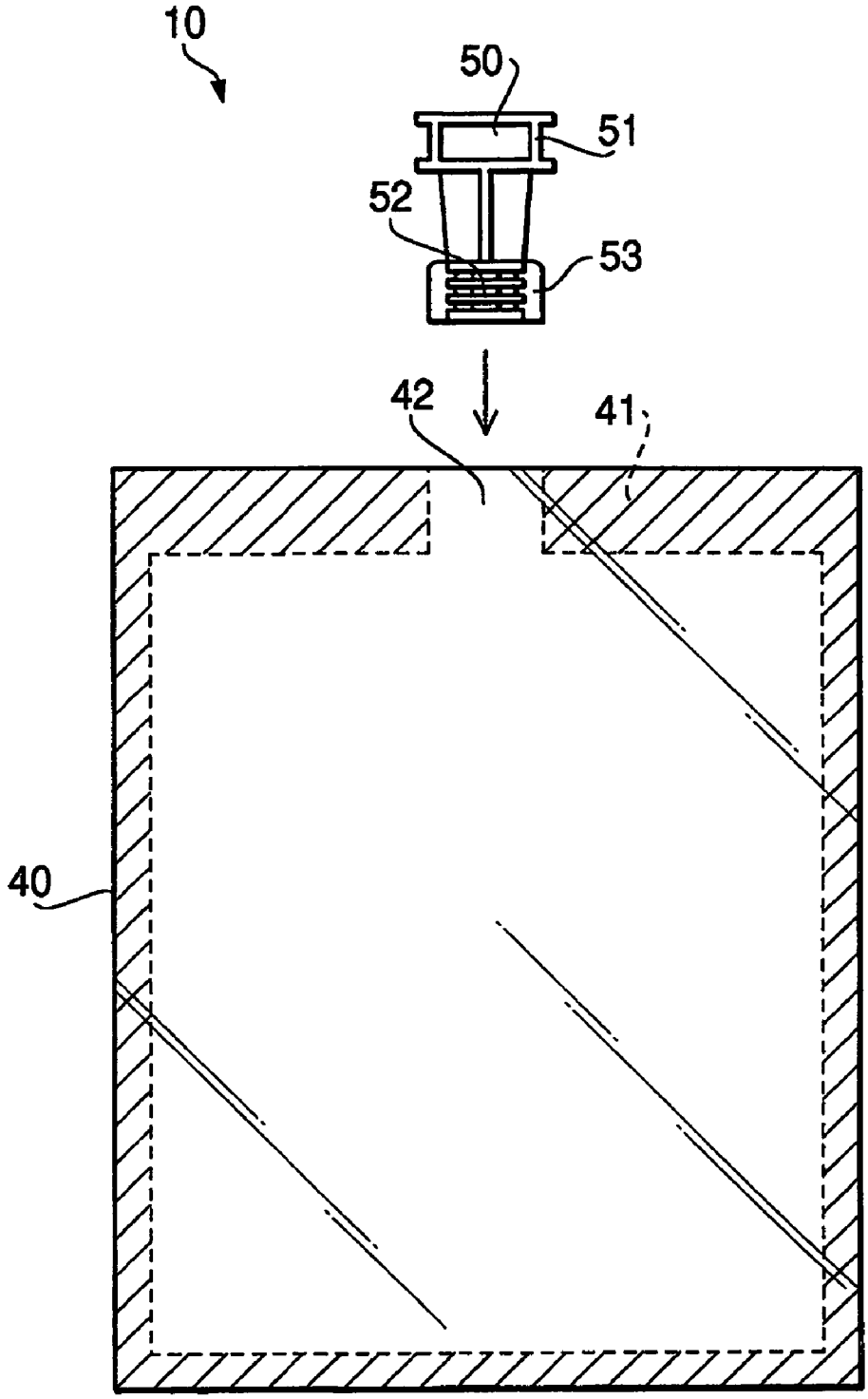
FIG. 2 is a plan view of the ink pack illustrating a producing process of the ink pack.
Figure 3:
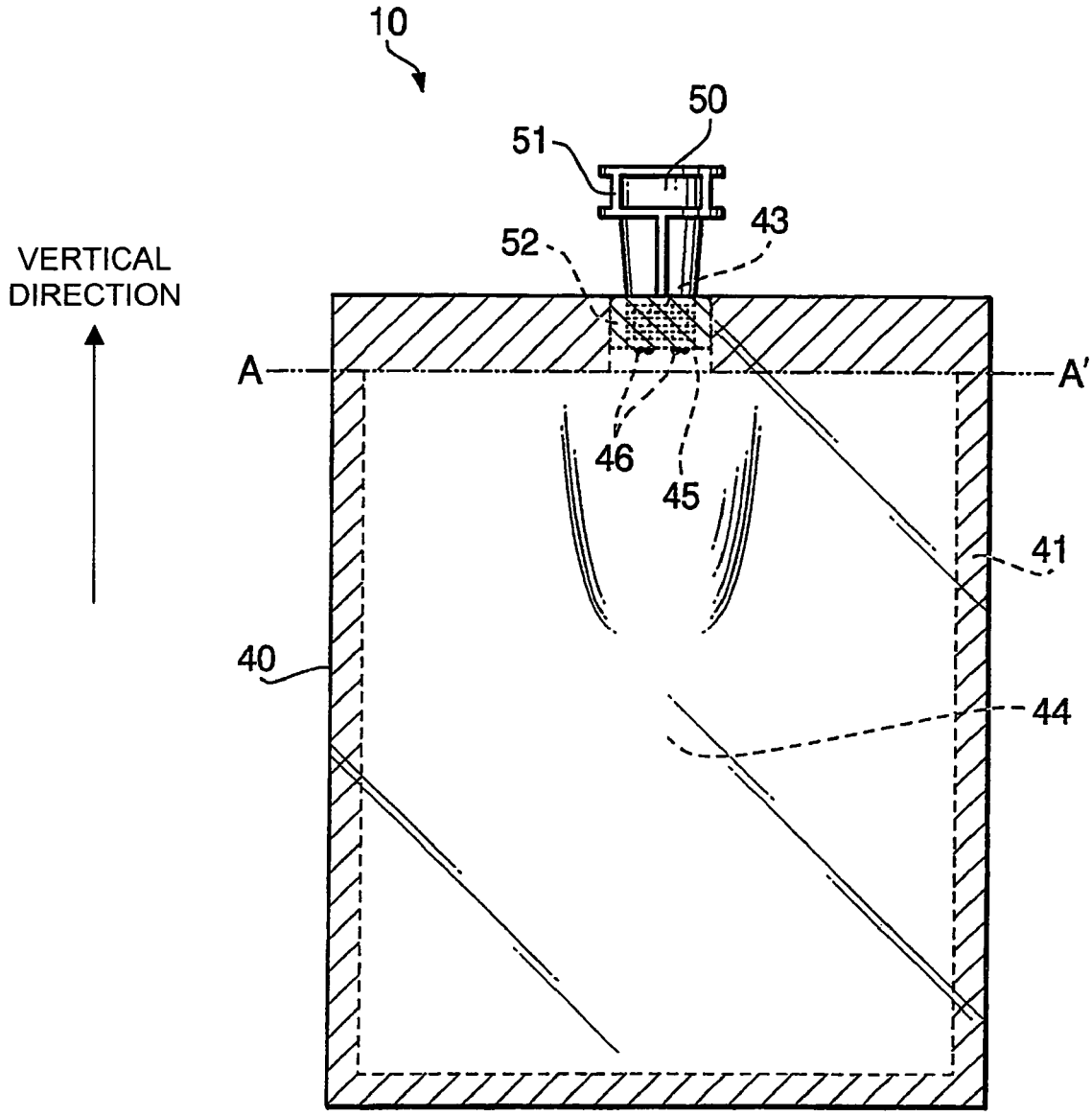
FIG. 3 is a plan view of the produced ink pack.

Hereafter, the ink pack 10 will be explained in detail. FIG. 2 is a plan view of the ink pack 10 illustrating a producing process of the ink pack 10. FIG. 3 is a plan view of the produced ink pack 10. In FIGS. 2 and 3, an up-and-down direction is defined as a vertical direction of the ink pack 10, and a left-and-right direction is defined as a lateral direction of the ink pack 10. In FIG. 3, a line A-A' represents a line passing through the lower end of a film welding part 41 along one of edges of a film bag 40 and extending in parallel with the lateral direction of the ink pack 10.

The ink pack 10 is produced as follows. First, a resin film is overlapped on another resin film so that four sides of the two films coincide with each other. Each film has a laminated structure in which a polystyrene layer is adhered to one surface of a nylon film and a polyethylene telephthalate layer is adhered to the other surface of the nylon film. The two films are overlapped with each other such that inner surfaces (heat seal surfaces facing to each other) of the two films are formed with the polystyrene layer having thermally dissolving property, while outer surfaces (protective surfaces facing the outside of the ink pack 10) of the two films are formed with the polyethylene telephthalate layer having the property of protecting water and air from passing therethrough.

The film bag 40 having a form of a bag is formed by welding the edges of one film to the edges of the other film. More specifically, by heating each edge portion (at which a pair of edges of the two film are overlapped with each other), the heat seal surfaces (polystyrene layers) of the two film adhere to each other, thereby forming film welding part 41. In this case, a central part of the top edge of the film bag 40 is not welded so that a space (a tap attachment part 42), to which a tap 50 can be attached, is formed. The size of the tap attachment part 42 is determined so that at least the lower edge of the tap 50 can be fitted into the tap attachment part 42.

As shown in FIG. 3, the tap attachment part 42 is welded in a state in which the tap 50 is fitted into the tap attachment part 42. The tap 50 serves to sealing the film bag 40 which is to be filled with ink and to introduce the ink to the outside of the film bag 40. The tap 50 may be made of a material capable of attaining the heat sealing with the inner surfaces of the ink pack 40. Preferably, the tap 50 is made of the material which is the same as or similar to the material of the inner surfaces of the ink pack 40 in regard to the improvement of the property of heat sealing. In this embodiment, the tap 50 is molded with polyethylene.

As shown in FIGS. 2 and 3, the tap 50 has a main body 51 having a cylindrical shape, and a connection part 52 having a cylindrical shape and having a cross section smaller than that of the main body 51. The main body 51 and the connection part 52 are arranged coaxially. Two welding fins 53 are formed on the connection part 52 such that they protrude from the respective side parts of the connection part 52 in parallel. An ink flow hole 55 is formed in the inside of the main body 51 and the connection part 52 to penetrate through the main body 51 and the connection part 52 in an axial direction (see FIGS. 4 and 5).

The connection part 52 provided with the welding fins 53 is fitted into the tap attachment part 42, and are welded to the tap attachment part 42. Specifically, if the connection part 52, the welding fins 53 and the attachment part 42 are heated together in the state in which connection part 52 provided with the welding fins 53 is fitted into the tap attachment part 42, a surface of the connection part 52 is welded to the inner surface (heat sealing surface) of the film bag 40 and the welding fin 53 is welded to the inner surface of the film bag 40. Consequently, a tap welding part 53 is formed.

In this embodiment, the connection part 52 is welded to the tap attachment part 42 such that the fins 53 completely dissolve and are combined with the inner surface of the film bag 40. The surface of the connection part 52 is provided with more than one rail-like projections formed in a circumferential direction of the connection part 52 so that the tap 50 welded to the tap welding part 43 is hardly detached from the tap welding part 52. Consequently, the film welding part 41 and the tap welding part 43 are formed at the edge part of the film bag 40, and a sealed chamber (a sealed ink chamber 44), which is to be filled with ink, is formed in the film bag 40.

In this embodiment, each of the length of the connection part 52 and the length of the welding fins 53 in the vertical direction is smaller than the welding width of the film welding part 41 formed at the upper edge of the film bag 40 in the vertical direction. Therefore, after the tap 50 is welded to the tap attachment part 42, the welding width in the tap welding part 43 in the vertical direction is smaller than the welding length of the film welding part 41 in the vertical direction.

That is, the welding width along the side of the film welding part 41 adjacent to the tap welding part 43 is larger than the welding width along the side of the tap welding part 43 adjacent to the film welding part 41. The difference between the welding width of the tap welding part 43 and the welding width of the film welding part 41 forms a cylindrical ink flow channel 45 extending in the vertical direction (the up-and-down direction in FIG. 3) between the sealed ink chamber 44 and the tap welding part 43.

Meanwhile, when the tap 50 is welded to the film bag 40, a resin dissolved from the film bag side or the tap side during the welding solidifies at the position immediately under the under edge of the tap 52 in the ink flow channel 45. For this reason, poly pools 46 are formed at the under edge of the tap welding part 43 in the ink flow channel 45, as shown in FIG. 3. The ink pack 10 in which the tap 50 is welded to the film bag 40 is thus attained.

Figure 4:
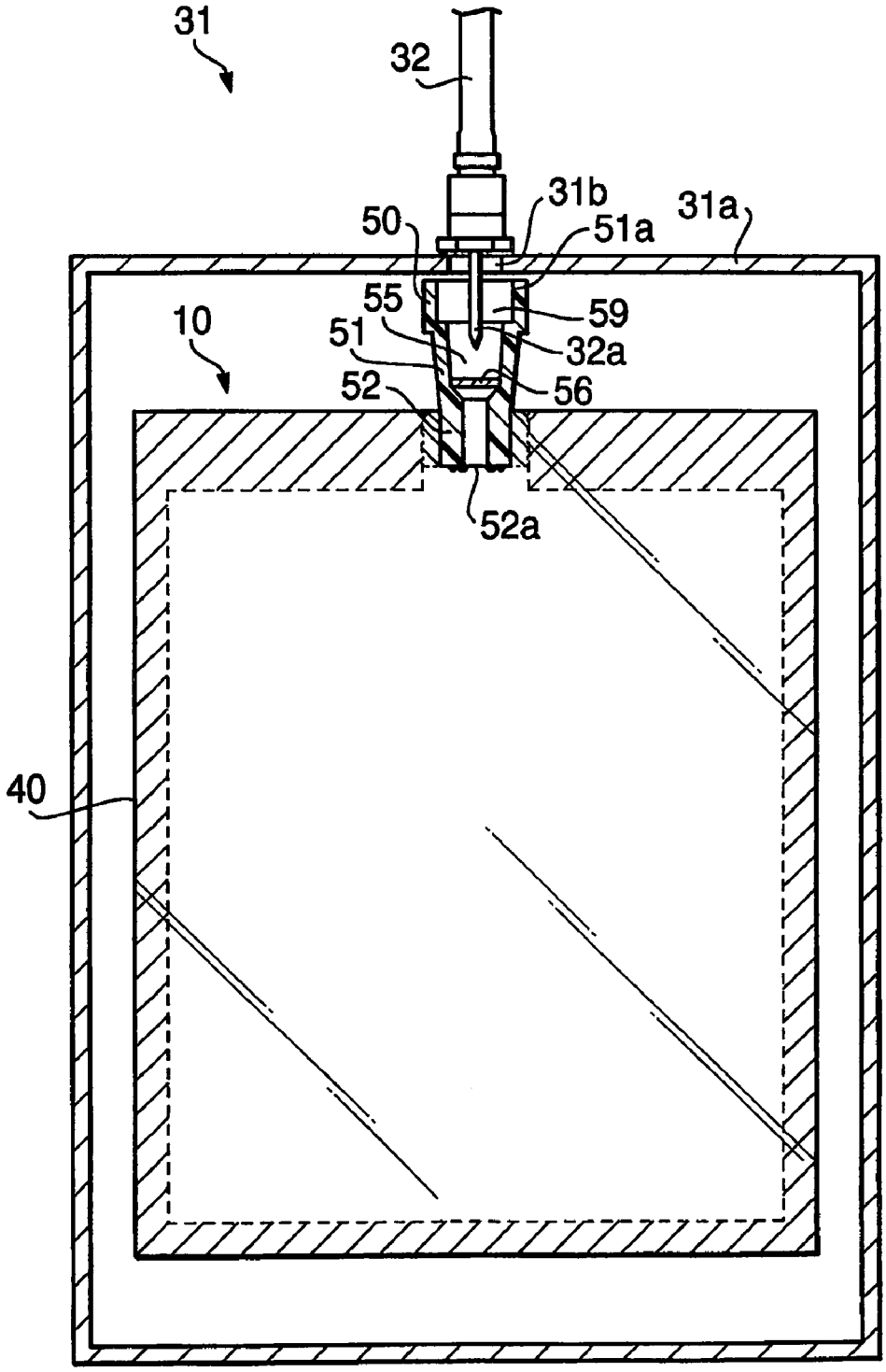
FIG. 4 is a cross sectional view of the ink cartridge viewed as a plan view.
Figure 5:
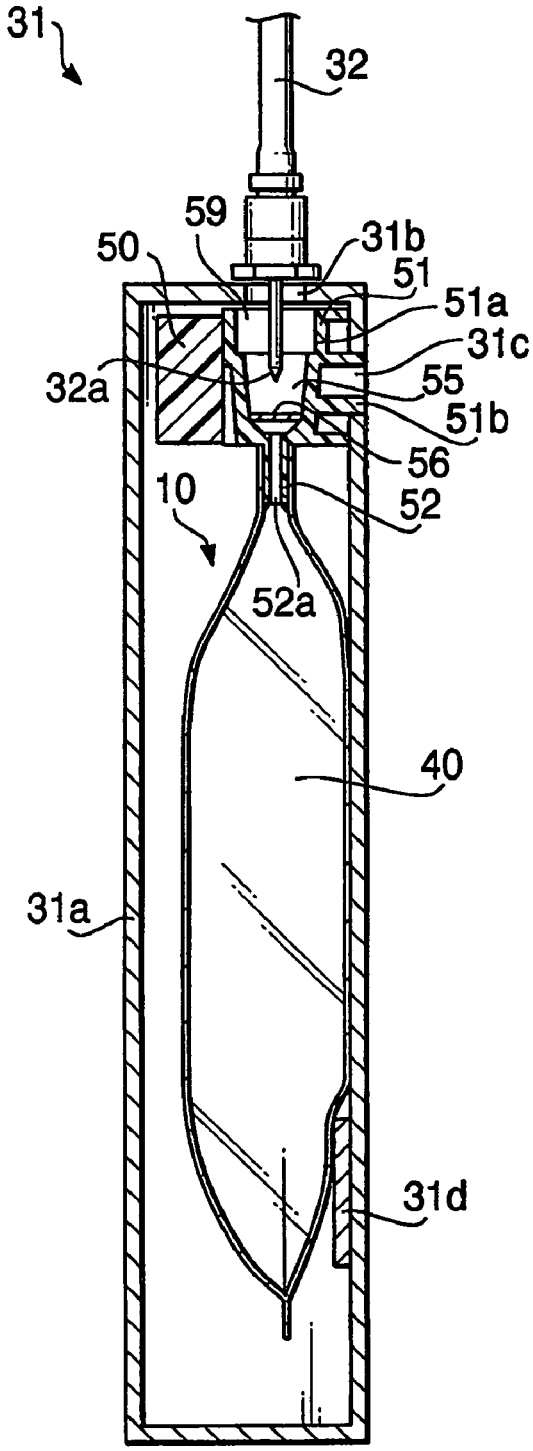
FIG. 5 is a side cross section of the ink cartridge.

Hereafter, the ink cartridge 31 will be explained. FIG. 4 is a cross sectional view of the ink cartridge 31 viewed as a plan view. Specifically, FIG. 4 shows a cross section formed by a horizontal plane passing through the ink flow hole 55. FIG. 5 is a side cross section of the ink cartridge 31. Specifically, FIG. 5 shows a vertical cross section passing through the ink flow hole 55.

As shown in FIGS. 4 and 5, the ink cartridge 31 has a form of a thin box. The ink cartridge 31 has a case 3 la (for example, formed of a flat box-shaped cardboard) accommodating the ink pack 10. The case 31*a* is formed so that clearance is formed around the outer circumference of the ink pack 10 in a state in which the ink pack 10 is accommodated in the ink cartridge 31.

At the top portion of the tap 50, a hole 51*a* is formed. At the bottom portion of the tap 50, a hole 52*a* is formed. Each of the hole 51*a* and the hole 52*a* communicates with the ink flow hole 55. The hole 51*a* located at the top portion of the tap 50 is blocked by a rubber stopper 59 having a flat cylindrical shape. The ink flow hole 55 is formed such that the diameter increases gradually toward the hole 51*a* from the hole 52*a*. A filter 56, through which ink passes, is provided in the ink flow hole 55. The main body 51 has a positioning projection 51*b* integrated to a bottom side of the main body 51 (see FIG. 5).

A circular hole 31*b* is formed at a central position of one of side walls of the case 31*a* at a position to which the hole 51*a* of the main body 50 faces. In the bottom surface of the case 31*a*, a positioning hole 31*c* is formed at a position immediately under the hole 51*a* (see FIG. 5). To the positioning hole 31*c*, the projection 51*b* of the tap 50 is fitted. To the bottom surface of the case 31*a*, a narrow band-shaped pad 31*d* (for example, made of cardboard) is adhered at a position near the rear end of the film bag 40. The pad 31*d* serves to lift the rear side (located opposite to the tap 50) of the film bag 40.

At the center position of the rubber stopper 59 blocking the hole 51*a*, a conducting needle 32*a*, formed at the tip of the ink supply tube 32, is inserted from the hole 32*b* side so that the tip of the conducting needle 32*a* is located in the ink flow hole 55 of the tap 50. With this structure, the ink in the sealed ink chamber 44 is introduced into the ink supply tube 32 through the ink flow hole 55 and the conducting needle 32*a*, and is supplied to the inkjet head 21 at the other end of the ink supply tube 32.

If the amount of ink in the ink pack 10 in the ink cartridge 31 becomes low, a user is allowed to replace the ink cartridge 31 with new one by pulling out the conducting needle 32*a* from the rubber stopper 59, detaching the ink cartridge 31 from the cartridge containment portion 30, and then attaching a new ink cartridge to the cartridge containment portion 30.

Figure 6:
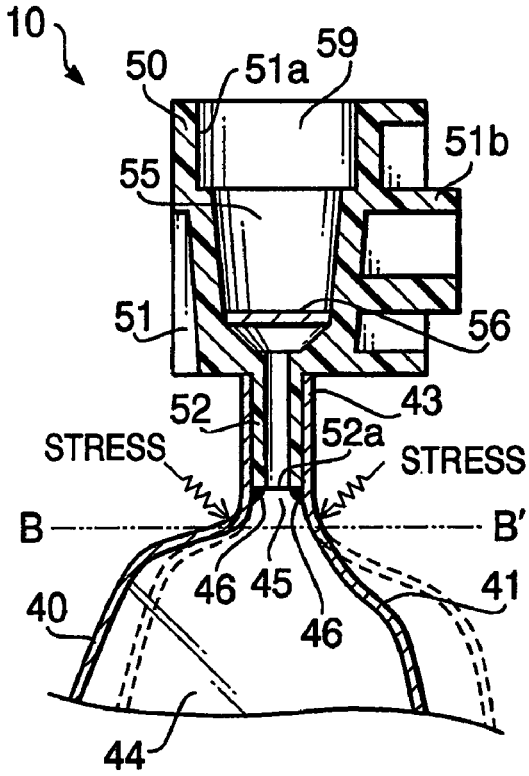
FIG. 6 is an enlarged partial side cross section of the ink pack.

Hereafter, the function of the ink pack 10 will be explained. FIG. 6 is an enlarged side cross section of the ink pack 10. In FIG. 6, only an essential part of the ink pack 10 is illustrated for the sake of simplicity. In FIG. 6, a line B-B' represents a line passing through the lower end of the film welding part 41 (to which the tap 50 is attached), in parallel with the back and forth direction of the ink pack 10.

As shown in FIGS. 4 and 5, the film bag 40 is inflated such that the side cross section thereof has an elliptical shape around the axial direction of the ink flow hole 55 because the sealed ink chamber 44 is filled with the ink. If the ink flows in the sealed ink chamber 44 or if an external force (e.g. vibration) is applied to the ink cartridge 31, a stress capable of deforming the film bag 40 is generated and is applied to the ink pack 10 (see a dashed line of FIG. 6).

As described above, the tap 50 is fixed to the ink cartridge 31 by the projection 51*b*. In addition, the film welding part 41 is hardly bent by the stress because the strength of the film welding part 41 is increased by the welding. Therefore, if the stress is applied to the ink pack 10, the film bag 40 tends to swing in the back and forth direction (the direction of the line B-B' in FIG. 6) around the axis (the line A-A' in FIG. 3) passing through the lower end of the film welding part 41. In this case, the deforming force (stress) concentrates on the portion around which the axis (the line A-A' in FIG. 3) passing through the lower end of the film welding part 41 and an axis in the back and forth direction (the direction of the line B-B' in FIG. 6) intersect with each other.

However, in this embodiment, the poly pools 46 (which are the weakest parts in the ink pack 10) are generated at the inside of the ink flow channel 45. In addition, the ink flow channel 45 is formed to have a cylindrical shape by the film welding part 41. That is, the poly pools 46 are surrounded and protected by the film welding part 41. Therefore, if the film bag 40 deforms, the stress hardly applies to the poly pools 46. In other words, the film bag 40 hardly deforms at the position of the poly pools 46.

As described above, the film welding part 41 and the tap welding part 43 are formed along an edge (of the film bag 40) to which the tap 50 is welded. The welding width along the side of the film welding part 41 adjacent to the tap welding part 43 is larger than the welding width along the side of the tap welding part 43 adjacent to the film welding part 41. Therefore, the poly pools 46 are surrounded and protected by the film welding part 41.

The ink flow channel 45 is formed in the space between the tap welding part 43 and the sealed ink chamber 44, so that the poly pools 46 are generated in the ink flow channel 45. With this structure, the tap 50 communicates with the sealed ink chamber 44 via the ink flow channel 45. Such a configuration prevents the film bag 44 from being bent by the stress at the position of the poly pools 46.

The stress caused by an external force or a flow of ink hardly acts on the poly pools 46 which are the weakest parts in the ink pack 10, by which the durability of the entire configuration of the ink pack 10 and the ink cartridge 31 can be enhanced.

Second Embodiment

Figure 7:
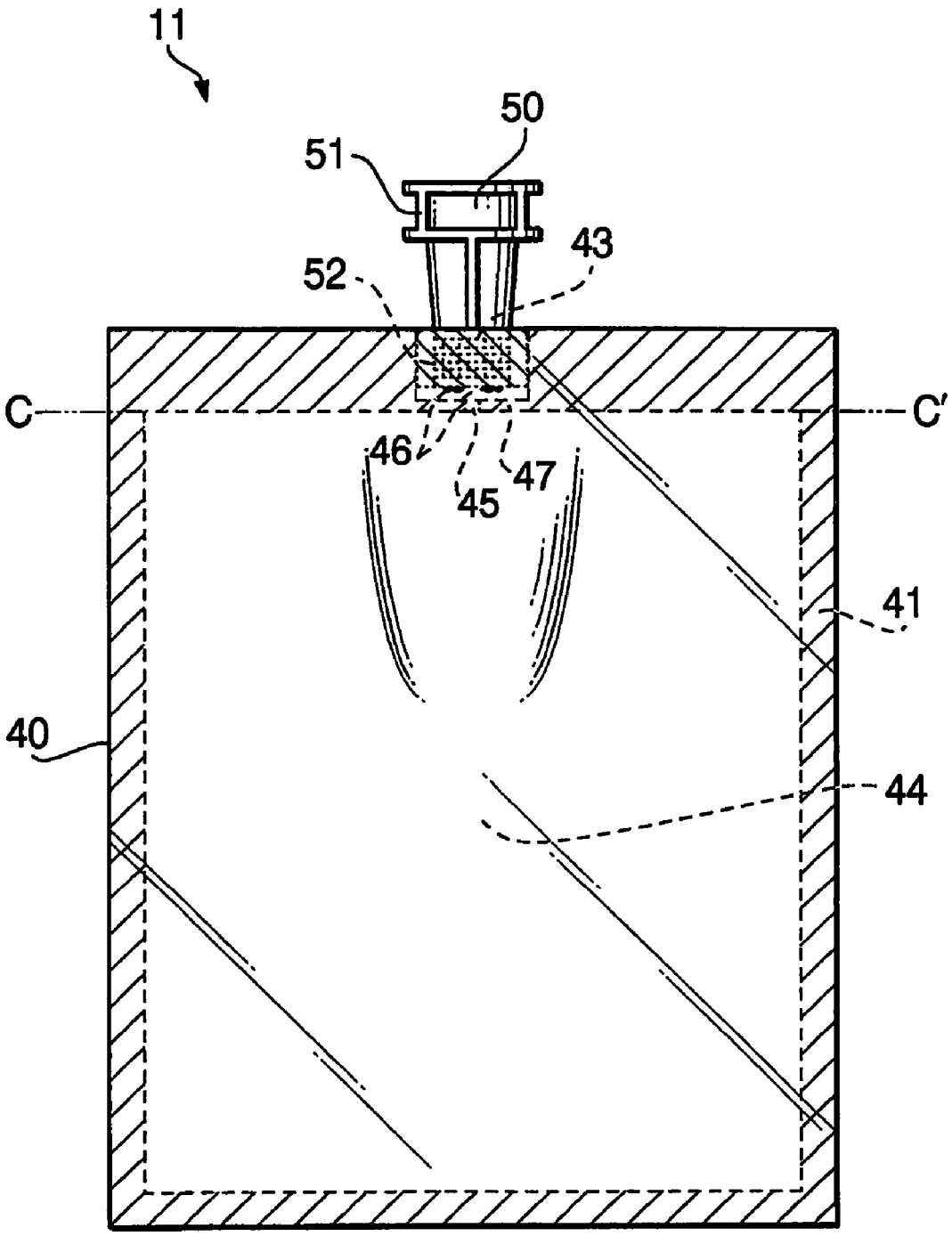
FIG. 7 is a plan view of an ink pack according to a second embodiment.

Hereafter, an ink pack 11 according to a second embodiment will be explained. Since a configuration of the ink pack 11 according to the second embodiment is similar to the ink pack 10 according to the first embodiment, only the feature of the ink pack 11 is explained. FIG. 7 is a plan view of the ink pack 11. In FIG. 7, to elements, which are equivalent to those of the first embodiment, the same reference numbers are assigned, and explanations thereof will not be repeated. The feature of the ink pack 11 is a structure of the film welding part.

In FIG. 7, a line C-C' is a line passing through the lower end of the ink welding part 41 (located along the edge of the film bag 40 to which the tap 50 is attached) and an ink flow channel welding part 47, in parallel with the back and forth direction of the ink pack 11.

As shown in FIG. 7, the ink flow channel welding part 47 is formed such that a welded part of the film bag 40 (i.e., the welding part 41 adjacent to the ink flow channel 45) protrudes toward the inside of the ink flow channel 45 from the lower end (the line C-C' in FIG. 7) of the film welding part 41. That is, an area of an opening of the ink flow channel 45, which is formed to have a cylindrical shape by the film welding part 41, is reduced at the ink flow channel welding part 47.

As described above, the tap 50 is fixed to the ink cartridge 31 through the projection 51*b*, and the mechanical strength of the film welding part 41 is high and is hardly bent. In addition, the thickness of the ink flow channel welding part 47 is increased because the inner surfaces of the film bag 40 are welded to each other at the region of the ink flow channel welding part 47. The strength of the ink flow channel welding part 47 is thus increased and is hardly bent. Therefore, if a stress is applied to the ink pack 11, the ink pack 11 tends to deform in such a manner that it bends in the back and forth direction (the direction of the line B-B' in FIG. 6) around the axis (the line C-C' in FIG. 7) along the lower end of the film welding part 41 and the ink flow channel welding part 47.

The poly pools 46 are located in the ink flow channel 45 formed by the film welding part 41, and the size of a part of the ink flow channel 45 immediately under the poly pools 46 is narrowed. That is, the poly pools 46 are surrounded and protected by the film welding part 41 and the ink flow channel welding part 47. Therefore, if the film bag 40 deforms, the stress hardly acts on the poly pools 46. In other words, the ink pack 11 hardly bent by the stress at the position of the poly pools 46.

As described above, according to the second embodiment, the ink flow channel welding part 47 is formed such that a lower end portion of the ink flow channel 45 is narrowed. Therefore, it is possible to further enhance the advantage of protecting the poly pools 46 and preventing the poly pools 46 from being bent by the stress.

Third Embodiment

Figure 8:
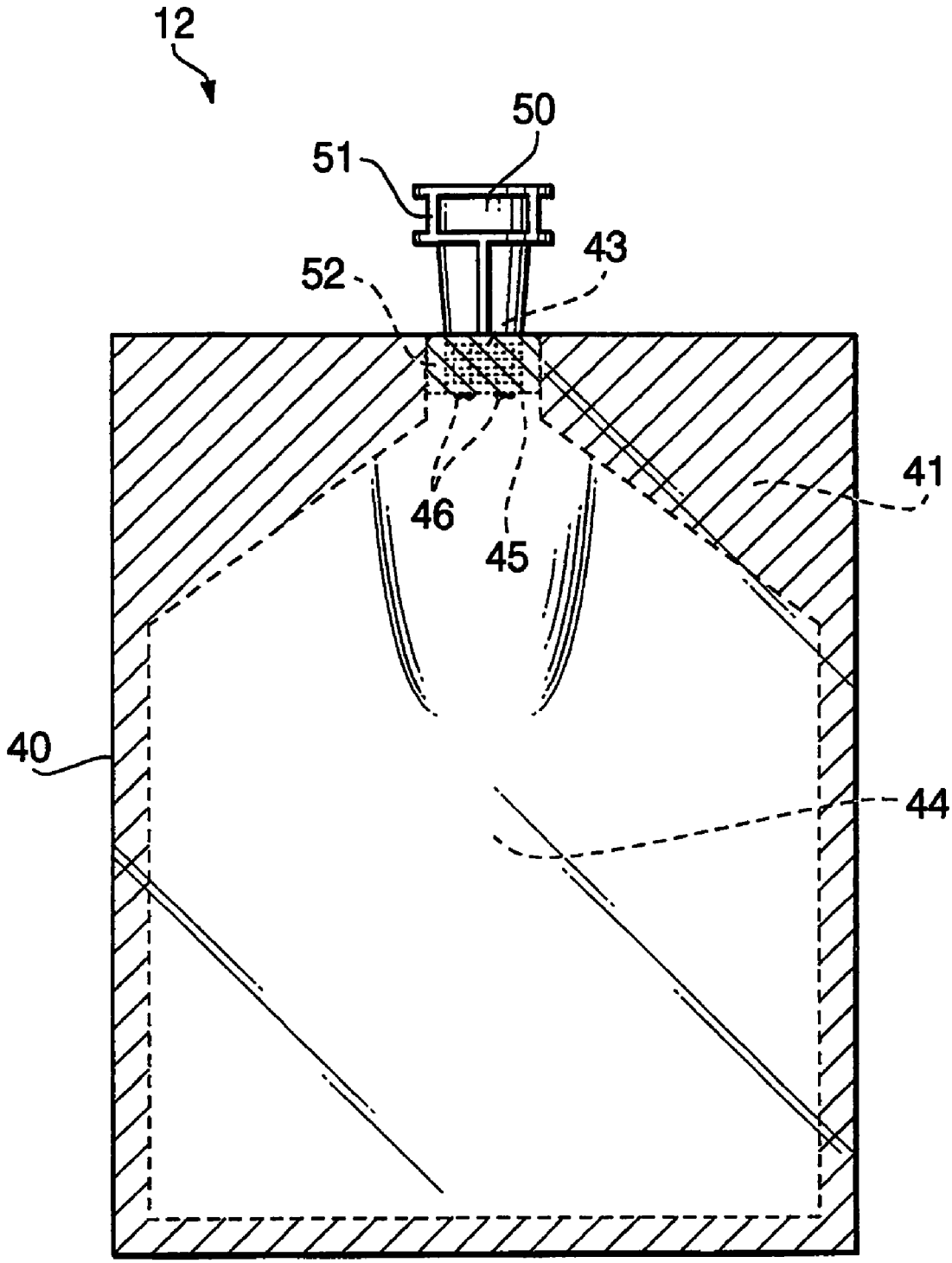
FIG. 8 is a plan view of an ink pack according to a third embodiment.
Figure 9:
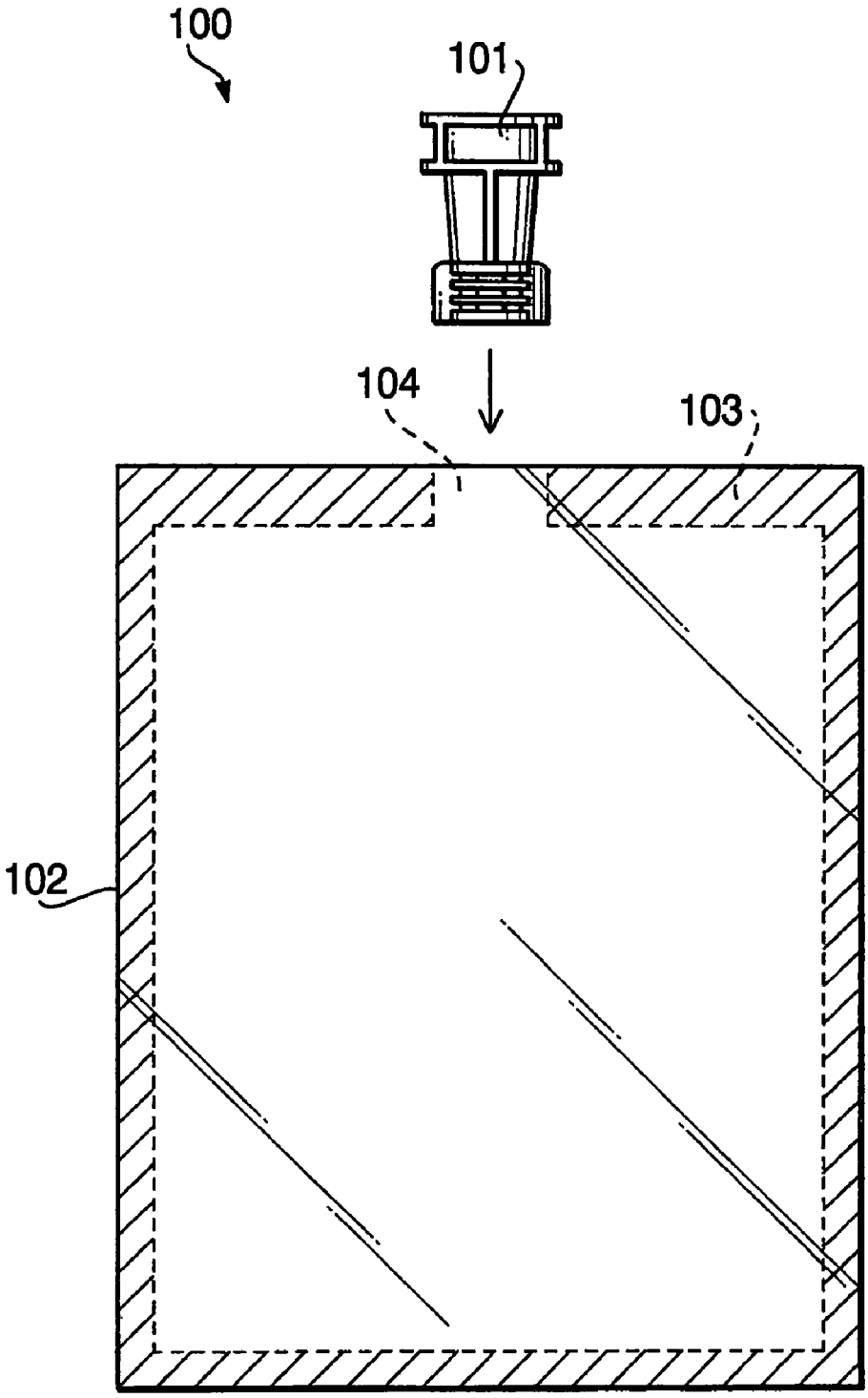
FIG. 9 PRIOR ART
FIG. 9 is a plan view of a conventional ink pack illustrating a producing process of the ink pack.
Figure 10:
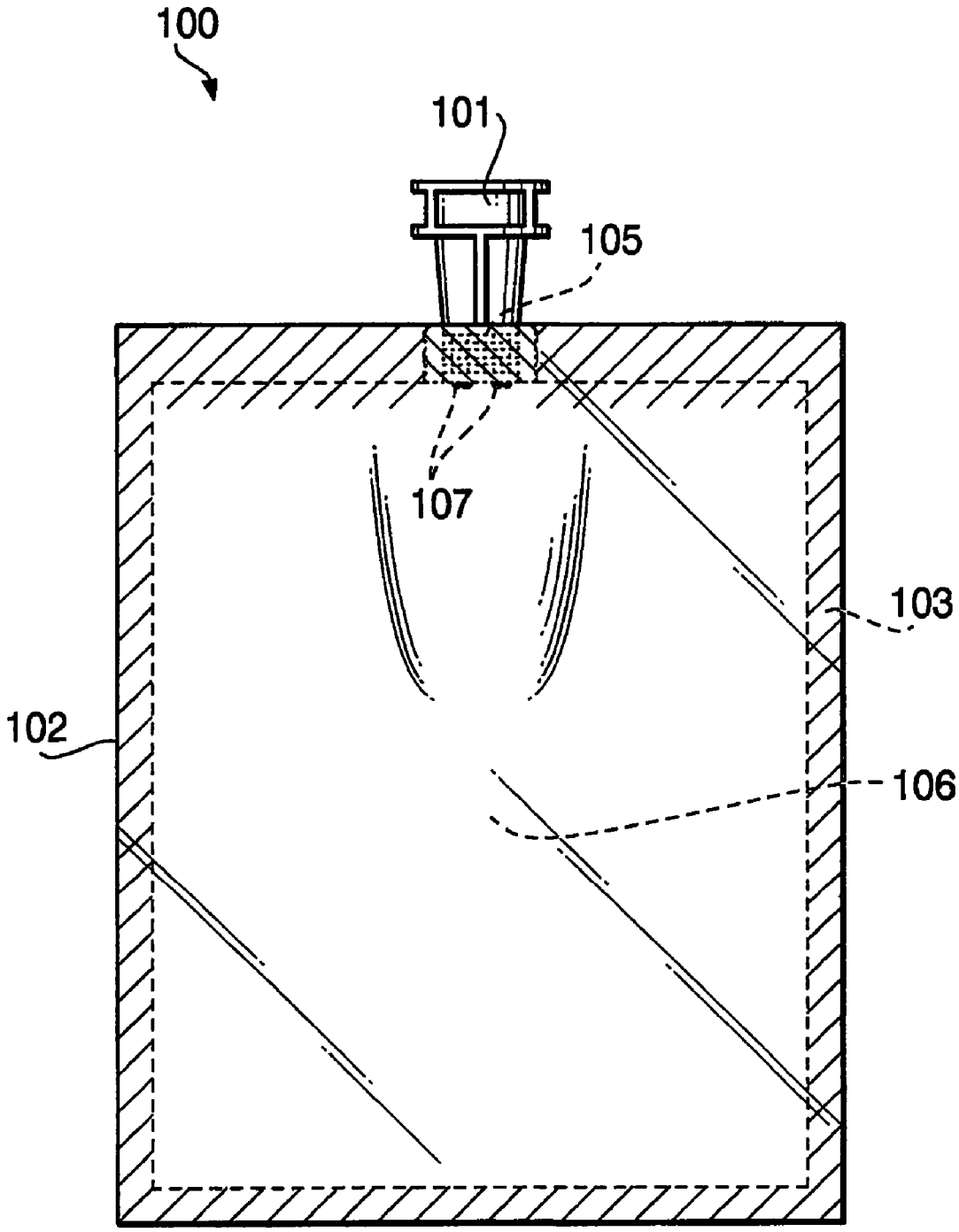
FIG. 10 PRIOR ART
FIG. 10 is a plan view of the conventional ink pack of FIG. 9.
Figure 11:
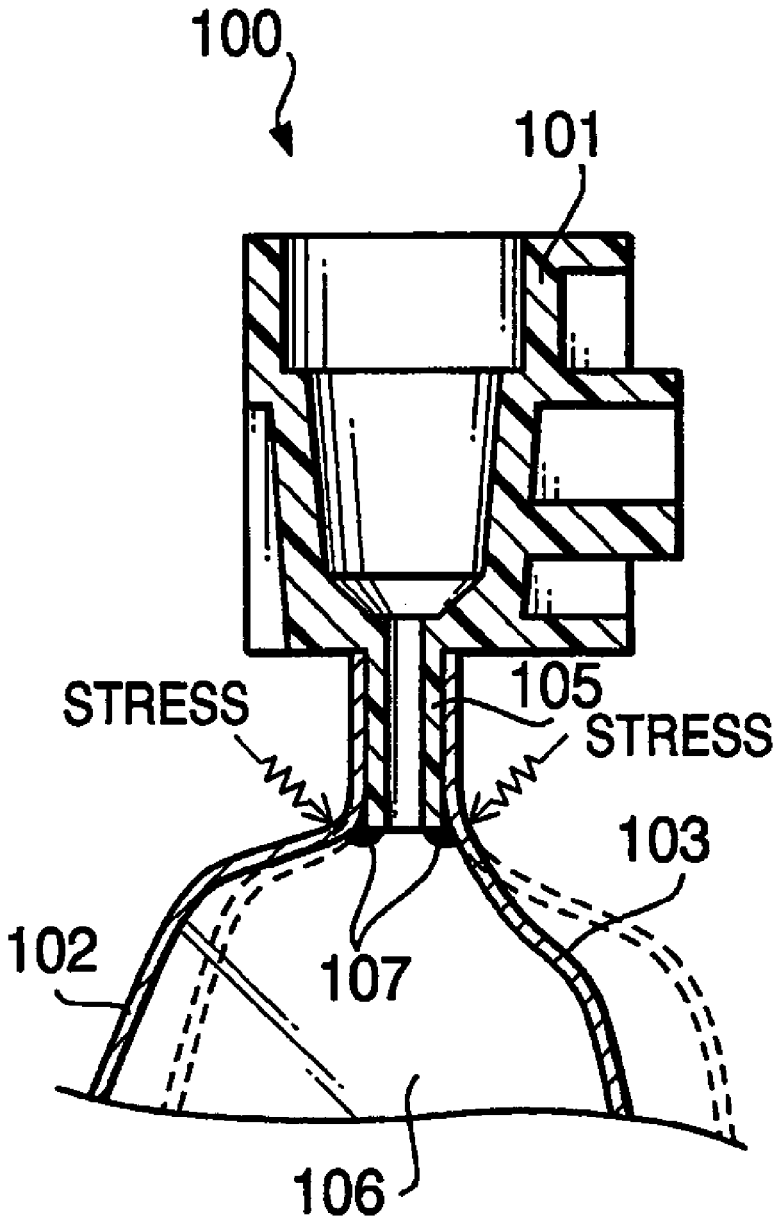
FIG.11 PRIOR ART
FIG. 11 is an enlarged partial side sectional view of the conventional ink pack.

Hereafter, an ink pack 12 according to a third embodiment will be explained. Since a configuration of the ink pack 12 according to the third embodiment is similar to the ink pack 10 according to the first embodiment, only the feature of the ink pack 12 is explained. FIG. 8 is a plan view of the ink pack 12. In FIG. 8, to elements, which are the equivalent to those of the first embodiment, the same reference numbers are assigned, and explanations thereof will not be repeated. The feature of the ink pack 12 is a structure of the film welding part.

As shown in FIG. 8, the film welding part 41 has a tapered shape at its upper side. Specifically, the size of the film welding part 41 situated at the portion of each corner at the upper side decreases gradually toward the lower side from the position where the ink flow channel communicates with the sealed ink chamber 44. In other words, the size of the opening of the sealed ink chamber 44 decreases gradually toward the ink flow channel 45.

With this structure, the flow of ink from the inside of the sealed ink chamber 44 toward the ink flow channel 45 along the inner surface of the sealed ink chamber 44 is smoothed because an inner surface of the sealed ink chamber 44 inclined toward the ink flow channel 45 serves to guide the ink to the ink flow channel 45.

As described above, according to the third embodiment, the film welding part 41 is inclined toward the tap 50 in such a manner that the size of the opening of the sealed ink chamber 44 decreases. Therefore, it becomes possible to smoothly guide the ink in the sealed ink chamber 44 to the ink supply tube 32.

Although the present invention has been described in considerable detail with reference to certain preferred embodiments thereof, other embodiments are possible.

For example, ink cartridges respectively accommodating different types of ink packs selected from the ink packs 11, 12 and 13 may be provided in the inkjet printer.

In the above mentioned embodiments, the film bag has an overlapped structure of two films to have a form of a flat bag. However, various types of ink bags having the shape different from that illustrated in the embodiments may be employed. Fir example, a bag formed by folding a film into two, welding them to have a form of a pack or a so-called gazette bag may be employed as an ink pack. The size, the amount of ink to be filled into the ink pack, and the shape of the tap may be modified without departing from the scope of the invention.

It is understood that as long as the welding width along the side of the film welding part 41 adjacent to the tap welding part 43 is larger than the welding width along the side of the tap welding part 43 adjacent to the film welding part 41, the film welding part may have various types of shapes. For example, the film welding part 41 may be configured to have a rectangular or circular shape. The inclination angle of each tapered edge of the film welding part 41 with respect to one of edges of the film bag 40 showed in FIG. 8 may be modified.

Although in the above mentioned embodiments, the ink cartridge and the ink pack according to the embodiments are applied to the inkjet printer for printing images on fabric. However, the ink cartridge and the ink pack according to the embodiments may be applied to various types of inkjet printers such as a printer designed to print images on paper, a line printer or a bubble jet printer.

What is claimed is:

1. An ink pack, comprising:

a film bag that has a sealed chamber therein and is formed of a flexible film member having a form of a bag;

a tap that has an ink flow channel therein and is welded to one edge of the flexible film member;

a film welding part, in which opposed inner surfaces of the flexible film member are welded to each other, formed at least along the one edge of the flexible film member; and a tap welding part, in which a side of the tap is welded to opposed inner surfaces of the flexible film member, formed in the one edge of the flexible film member, wherein a welding width, in a direction in which ink flows through the ink flow channel, of a side of the film welding part neighboring the tap welding part is larger than a welding width, in the direction in which the ink flows through the ink flow channel, of a side of the tap welding part neighboring the film welding part, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

2. The ink pack according to claim 1, wherein a cylindrical ink channel is formed along a direction of the ink flow channel in a space formed between the tap welding part and the sealed chamber.

3. The ink pack according to claim 2, wherein an ink channel welding part, in which opposed inner surfaces of the flexible film member are welded to each other, is formed in the one edge of the flexible film member so that a width of a part of the cylindrical ink channel is narrowed.

4. The ink pack according to claim 1, wherein the film welding part has a part inclined with respect to one edge of the flexible film member so that an area of an opening of the sealed chamber becomes narrower toward the tap.

5. The ink pack according to claim 1, wherein:

the flexible film member has a laminated structure; and inner surfaces of the flexible film member and the tap are made of the same material.

6. The ink pack according to claim 5, wherein the laminated structure of the film member includes a layer configured to block passing of water and air.

7. An ink cartridge, comprising:

the ink pack according to claim 1; and a case that accommodates the ink pack.

8. The ink pack according to claim 1, wherein the tap further comprises a fin in which the width of at least one of end of the fin is identical to the width of the recessed portion.

9. An ink pack, comprising:

a film bag that has a sealed chamber therein and is formed of a flexible film member having a form of a bag;

a tap that is welded to one edge of a peripheral part of the flexible film member;

a film welding part, in which opposed inner surfaces of the flexible film member are welded to each other, formed along the peripheral part of the flexible film member; and a tap welding part, in which a side of the tap is welded to opposed inner surfaces of the peripheral part of the flexible film member, formed in the peripheral part of the flexible film member adjacent to the film welding part, wherein a welding width, in a direction in which ink flows through the tap, of a side of the film welding part neighboring the tap welding part is larger than a welding width, in the direction in which the ink flows through the tap, of a side of the tap welding part neighboring the film welding part, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

10. The ink pack according to claim 9, wherein an end of the tap welding part on a side of the sealed chamber is closer to the one edge of the flexible film member than an end of the film welding part on a side of the sealed chamber.

11. The ink pack according to claim 9, wherein:

the tap has an ink flow channel that connects the sealed chamber to an outside; and a rubber stopper is attached to the ink flow channel.

12. An ink pack, comprising:

a film bag that has a sealed chamber therein and is formed of a flexible film member having a form of a bag to accommodate ink therein;

a tap through which ink flows from an inside area of the sealed chamber to an outside area of the sealed chamber, the tap being welded to one edge of a peripheral part of the flexible film member; and a film welding part, in which opposed inner surfaces of the flexible film member are welded to each other, formed along the peripheral part of the flexible member, wherein a welding width, in a direction in which ink flows through the tap, of a side of the film welding part neighboring a tap welding part is larger than a welding width, in the direction in which the ink flows through the tap, of a side of the tap welding part neighboring the film welding part, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

13. The ink pack according to claim 12, further comprising:

the tap welding part, in which a side of the tap is welded to opposed inner surfaces of the peripheral part of the flexible member, formed in the peripheral part of the flexible film member adjacent to the film welding part;

wherein, in a direction along the one edge of the peripheral part of the flexible film member, a welding length of the film welding part is larger than a welding length of the tap welding part.

14. The ink pack according to claim 12, further comprising:

the tap welding part, in which a side of the tap is welded to opposed inner surfaces of the peripheral part of the flexible member, formed in the peripheral part of the flexible film member adjacent to the film welding part;

wherein:

the inner edge of the film welding part is divided into a plurality of partial edges by the tap welding part; and the plurality of partial edges of the film welding part are aligned in a line.

15. The ink pack according to claim 12, wherein the inner edge of the film welding part is formed in a straight line that is perpendicular to a longer side direction of the ink pack.

16. An ink pack, comprising:

a film bag that has a sealed chamber therein and is formed of a flexible film member having a form of a bag;

a tap that has an ink flow channel therein and is welded to one end of the film bag;

a film welding part, in which opposed inner surfaces of the flexible film member are welded to each other, formed at least along the one end of the film bag; and a tap welding part, in which a side of the tap is welded to opposed inner surfaces of the flexible film member, formed in the one end of the film bag, wherein a welding width of an edge of the film welding part at a point where the film welding part and the tap welding part meet is larger than a welding width of an edge of the tap welding part at the point where the film welding part and the tap welding part meet, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

17. An ink pack, comprising:

a film bag that has a sealed chamber therein and is formed of a flexible film member having a form of a bag;

a tap that is welded to one end of a peripheral part of the flexible film member;

a film welding part, in which opposed inner surfaces of the flexible film member are welded to each other, formed along the peripheral part of the flexible film member; and a tap welding part, in which a side of the tap is welded to opposed inner surfaces of the peripheral part of the flexible film member, formed in the peripheral part of the flexible film member adjacent to the film welding part, wherein a welding width of an edge of the film welding part at a point where the film welding part and the tap welding part meet is larger than a welding width of an edge of the tap welding part at the point where the film welding part and the tap welding part meet, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

18. An ink pack, comprising:

a film bag that has a sealed chamber therein and is formed of a flexible film member having a form of a bag to accommodate ink therein;

a tap through which ink flows from an inside area of the sealed chamber to an outside area of the sealed chamber, the tap being welded to one end of a peripheral part of the flexible film member; and a film welding part, in which opposed inner surfaces of the flexible film member are welded to each other, formed along the peripheral part of the flexible member, wherein a welding width of an edge of the film welding part at a point where the film welding part and a tap welding part meet is larger than a welding width of an edge of the tap welding part at the point where the film welding part and the tap welding part meet, and a difference between the welding width of the film welding part and the welding width of the tap welding part forms a cylindrical recessed portion extending in a direction parallel to the direction in which ink flows through the ink flow channel, the cylindrical recessed portion being between the sealed chamber and the tap welding part.

* * * * *